United States Patent [19]

Dickens et al.

[11] Patent Number: 4,478,901

[45] Date of Patent: Oct. 23, 1984

[54] FLOOR MAT CONSTRUCTION

[75] Inventors: David R. Dickens, Lincoln; Waldo Smith, Warwick; Herbert Malin, Barrington, all of R.I.

[73] Assignee: Teknor Apex Company, Pawtucket, R.I.

[21] Appl. No.: 445,544

[22] Filed: Nov. 29, 1982

[51] Int. Cl.[3] ..... E01C 5/18; B32B 3/24

[52] U.S. Cl. ..... 428/120; 428/131; 428/134; 428/135; 52/177; 404/36; 404/42

[58] Field of Search ..... 428/131, 135, 44, 134; 404/36, 42, 43; 52/177, 180; 15/215, 216

[56] References Cited

U.S. PATENT DOCUMENTS

| | | | |
|---|---|---|---|
| 82,647 | 9/1868 | Shepard | 15/215 |
| 3,846,945 | 11/1974 | Roby | 404/36 X |
| 4,111,585 | 9/1978 | Mascaro | 404/36 X |

*Primary Examiner*—Alexander S. Thomas
*Attorney, Agent, or Firm*—Salter & Michaelson

[57] ABSTRACT

A floor mat construction of rubberized material including a base and feet of barbell-like configuration which extend integrally downwardly from the underside of the base for the support thereof in upwardly spaced relation on a supporting surface. A plurality of apertures the upper ends of which are of substantially hexagonal configuration, extend through the base to define a hexagonal honeycomb-like configuration in the upper portion thereof. The mat is lightweight but structurally efficient, the upper surfaces of the common walls between the hexagonal upper ends of the apertures providing durable scraping surfaces for a nonskid effect, and the feet firmly gripping the supporting surface therebeneath to resist creeping of the mat.

6 Claims, 6 Drawing Figures

FLOOR MAT CONSTRUCTION

BACKGROUND AND SUMMARY OF THE INVENTION

The instant invention relates to floor mats and more particularly to a novel construction for a nonskid antifatigue floor mat of the type used in industrial and commercial applications, particularly in wet and/or greasy areas.

A wide variety of floor mats of the above type have heretofore been available for the above applications, and in this connection, certain qualities have been found to be desirable in well-designed floor mats. In particular, floor mats of this type should be designed so that water and other liquids effectively drain from the walking surfaces thereof to provide firm nonskid walking surfaces when used in wet and/or greasy areas. They should also be designed so that they resist creeping and remain in place even when used on wet or greasy surfaces. Further, well designed mats of this type must be flexible enough so that they conform to uneven floor surfaces and they must be made of materials which ae resistant to oil and/or chemicals, particularly those found in commercial kitchens. Preferably, mats of this type should also be at least slightly resiliently flexible to provide a cushionig effect for fatigue relief for those walking thereon and to reduce breakage of items dropped thereon, such as glasses and the like. In addition to all of these qualities, well designed floor mats should be durable enough to withstand frequent handling and folding, but nevertheless light enough so that they can easily be moved for cleaning.

The most common types of heretofore available floor mats have comprised a base made of a chemically resistant rubberized material having a plurality of spaced apertures therethrough, a plurality of raised rings or bosses which extend slightly upwardly around the peripheries of the upper ends of the apertures, and a plurality of rounded knobs which extend downwardly from the base. The raised rings provide scraping surfaces on the mat for a nonskid effect, while the rounded knobs maintain the mat in upwardly spaced relation when it is positioned on a supporting surface to allow drainage therefrom. In use the scraping surfaces of the mat remain relatively clean and dry and engage the soles of the shoes of persons working thereon to provide a nonskid walking surface. The knobs on the underside of the mat maintain the base in upwardly spaced relation to the supporting surface so that water and grease can effectively drain therefrom. Unfortunately, mats of this type have been less than fully effective for several reasons. In particular, the rings or bosses which are utilized to provide a scraping effect are inherently weak and tend to wear quickly. While mats of this type should be rugged enough to last for several years, it has been found that the scraping rings thereof frequently become worn or damaged after only a few months thereby causing substantial reductions in the effectiveness thereof to provide nonskid surfaces. It has also been found that mats of this type tend to creep on supportng surfaces, particularly when subjected to heavy traffic because of the rounded configurations of the supporting knobs. Most mats of this type have also been relatively heavy in their constructions weighing approximately 2.5 pounds per square foot, and as a result of National Sanitation Foundation standards which limit the weights of mats of this type to 40 pounds, they have been limited to the maximum sizes approximately of 16 square feet.

The instant invention provides a novel mat construction which overcomes many of the disadvantages of the heretofore known floor mats. In this regard, the floor mat construction of the instant invention comprises a rubberized base having a plurality of apertures therethrough and a plurality of feet which maintain the base in upwardly spaced relation when it is positioned on a supporting surface. In contrast to the heretofore known mat constructions, however, the apertures in the base are formed so that the upper portions thereof are substantially hexagonal and they are disposed in adjacent offset rows of aligned apertures wherein each of the sides of the hexagonal upper portions of the apertures define common walls with the adjacent sides of the hexagonal upper portions of adjacent apertures so that the apertures cooperate to define a honeycomb-like configuration in the upper portion of the base. This honeycomb-like configuration provides a nonskid effect in the mat of the instant invention, the edges of the hexagonal upper portions of the apertures providing scraping surfaces which replace the rings or bosses of the heretofore known mat constructions. The elimination of raised rings or bosses in the mat construction of the instant invention makes its substantially more durable for a long lasting nonskid effect. Further, the hexagonal honeycomb-like structure defined by the apertures is structurally efficient whereby mats constructed in accordance herewith may be constructed with substantially reduced weights per unit area. The feet which are formed on the underside of the base of the mat of the instant invention also represent a significant improvement over the previously known mat constructions. In this regard, the feet are formed in an elongated, preferably barbell-like configuration and have substantially flat bottom surfaces. The feet are positioned so that adjacent feet are in spaced relation and at angles of approximately 60° with each other. As a result of the configuration of the feet and the relative positions thereof, they provide a positive supporting structure for the base which is resistant to creep, but which nevertheless permits the base portion to be more elevated with respect to the supporting surface thereby permitting more effective drainage.

Accordingly, it is a primary object of the instant invention to provide a durable nonskid floor mat construction.

Another object of the instant invention is to provide an effective nonskid floor mat construction which does not include raised bosses or rings for scraping surfaces.

A further object of the instant invention is to provide an effective nonskid floor mat construction of reduced weight per unit mat area.

A still further object of the instant invention is to provide a nonskid floor mat construction which is resistive to creep.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
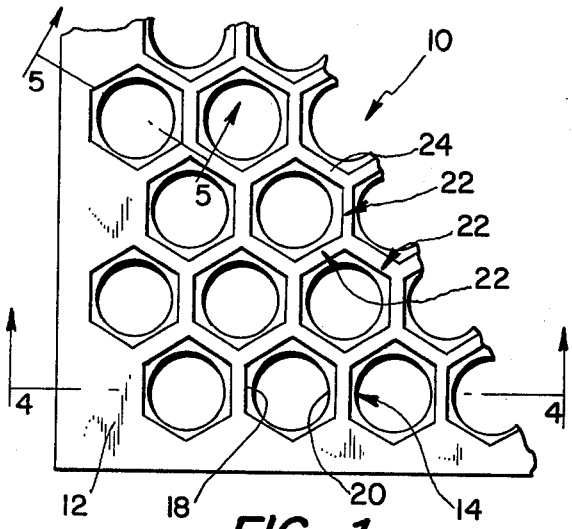
FIG. 1 is a fragmentary top plan view of the floor mat construction of the instant invention.

Referring now to the drawing, the floor mat construction of the instant invention is illustrated in FIGS. 1 through 6 and generally indicated at 10. The floor mat 10 is preferably integrally molded in a unitary construction of a suitable chemical resistant rubberized material, and generally comprises a base 12 having a plurality of apertures 14 therethrough and a plurality of feet 16 which extend integrally downwardly from the underside of the base 12, whereby the base 11 is maintained in slightly upwardly spaced relation when the floor mat 10 is positioned on a supporting surface.

The configuration of the interior area of the base 12 is substantially defined by the apertures 14 which include upper portions 18 of multisided geometric configuration, preferably hexagonal, which merge downwardly into inwardly tapered substantially circular lower portions 20. As illustrated most clearly in FIG. 1, the apertures 14 are disposed in offset diagonal rows of aligned apertures whereby adjacent sides of adjacent hexagonal upper portions 18 define common walls 22 therebetween which have substantially flat upper surfaces 24. Accordingly, the upper portions 18 and the common walls 22 cooperate to define a honeycomb-like configuration in the upper portion of the base 12 which provides an effective scraping surface on the floor mat 10 as will hereinafter be more fully set forth. The lower portion of the base 12 is defined by the substantially circular lower portions 20 as illustrated most clearly in FIG. 2.

Figure 2:
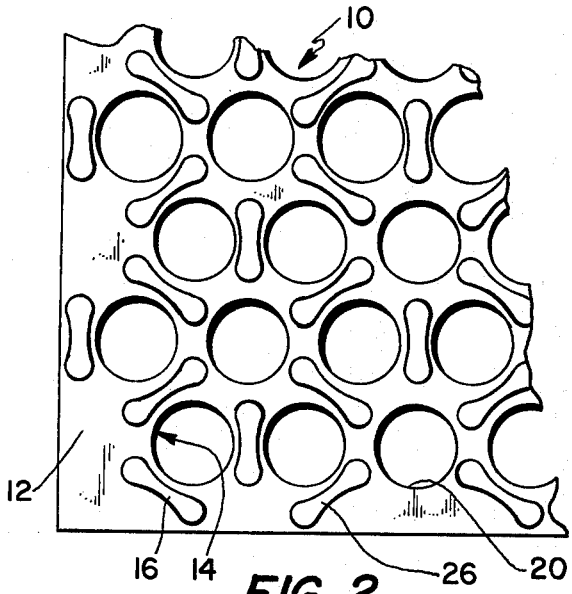
FIG. 2 is a fragmentary bottom plan view thereof.
Figure 3:
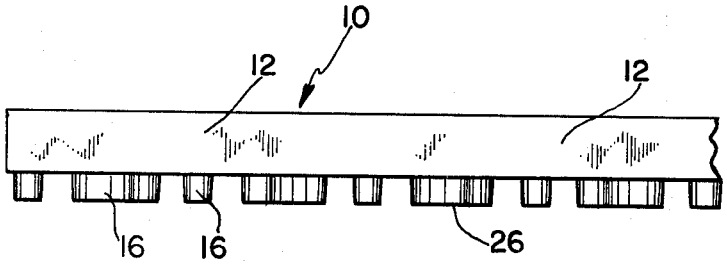
FIG. 3 is a fragmentary side elevational view thereof.
Figure 4:
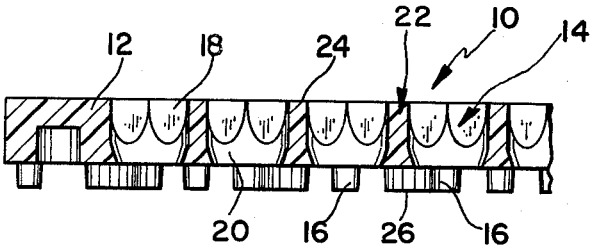
FIG. 4 is a side sectional view taken along line 4—4 in FIG. 1.
Figure 5:
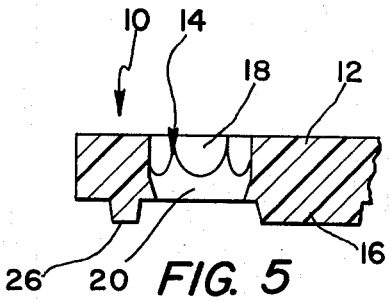
FIG. 5 is a sectional view taken along line 5—5 in FIG. 1.
Figure 6:
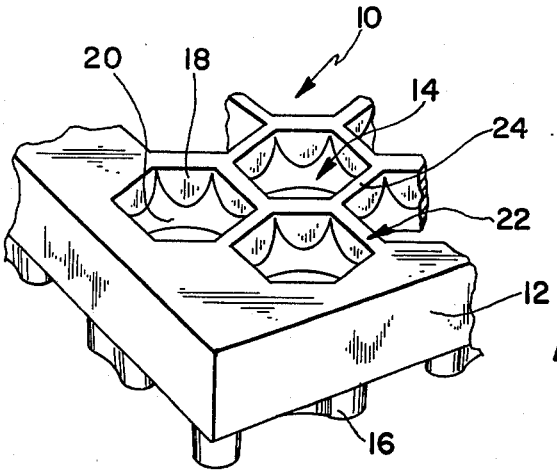
FIG. 6 is a fragmentary perspective view of the mat.

The feet 16 are slightly resiliently flexible and extend integrally downwardly from the base 12 for the support thereof in slightly upwardly spaced relation when the floor mat 10 is positioned on a supporting surface. As illustrated most clearly in FIG. 2, the feet 16 are of elongated barbell-like configuration terminating in substantially flat lower surfaces 26. The feet 16 are disposed so that the ends of adjacent feet 16 are in slightly spaced relation and so that the adjacent feet 16 are at angles of approximately 60° relative to each other. Accordingly, as illustrated in FIG. 2, the feet 16 encompass a substantial portion of the bottom surface of the base 12 to provide a firm cusioned support therefor without significant sagging of the base 12 but are spaced sufficiently to permit drainage of liquids from a supporting surface therebeneath.

The floor mat 10 is durable, efficient and lightweight. In this connection, the hexagonal honeycomb-like configuration of the upper portion of the base 12 as defined by the upper portions 18 is structurally efficient so that the walls 22 have sufficient rigidity to support persons walking thereon while nevertheless providing a cushioning effect for fatigue relief. Further, due to the structurally efficient configuration of the base 12, the floor mat 10 can be constructed so that the apertures 14 thereof encompass a greater proportionate share of the base 12 than was possible with the heretofore known mat constructions. This permits the floor mat 10 to be constructed with a smaller weight per unit area and with greater flexibility than was possible with the heretofore known mat constructions. Hence, the floor mat of the instant invention can be constructed with a greater overall dimension than the heretofore known duckboard type rubber floor mats. In fact, it has been found that durable lightweight floor mats having weights per unit area of less than 1.5 pounds per square foot are feasible when constructed in accordance with the instant invention. The structural efficiency of the floor mat 10 is further enhanced by the configurations of the lower portions 20 of the apertures 14. In this regard, the downwardly tapered aspect of the lower portions 20 increases the overall strength of the mat and provides additional surface area on the underside of the base 12 to accommodate the feet 16.

The feet 16 provide substantially improved resistance to creep in the floor mat construction of the instant invention, and hence also represent an aspect of significant improvement over the heretofore known floor mat constructions. In this connection, the elongated configurations of the feet 16 and the substantially flat bottom surfaces 26 thereof cause them to firmly grasp a supporting surface therebeneath, particularly when lateral forces are applied thereto. The barbell like configurations of the feet 16 tend to enhance this gripping action by providing increased overall area in the surfces 26 without restricting the drainage of liquid from the floor mat 10. The positioning of the feet 16 at angles of approximately 60° relative to each other provides an effective gripping action regardless of the direction of the force applied thereto. Hence, the feet 16 effectively eliminate the creeping tendencies found with the heretofore known floor mat constructions while at the same time permitting the base portion of the mat 10 to be somewhat more elevated with respect to the supportive surface, thereby promoting better drainage.

In application and use, the floor mat 10 provides an effective cushioned nonskid walking surface. More particularly, the common walls 22 defined by the apertures 14 have some resilience to enhance the cushioning effect in the mat 10 although they are structurally efficient. Further, the upper surfaces 24 of the walls 22 provide scraping surfaces which act to scrape moisture and grease from the soles of shoes of persons walking on the floor mat 10. This scraping action provides substantially dry contact between the soles of said shoes and the upper surfaces 24 to provide an effective nonskid effect in the floor mat 10. As water and grease are scraped from the soles of shoes, it passes through the apertures 14 and onto the supporting surface therebeneath. Further, since the surfaces 24 form the upper surface of the base 12, they are not prone to early wear or tearing, in contrast to the upwardly projecting rings and bosses heretofore used as scraping surfaces. The legs 16 contribute to the cushioning effect of the floor mat 10 and maintain the base 12 in more pronounced upwardly spaced relation to the supporting surface therebeneath to provide effective drainage. Further, the legs 16 effectively support the mat 10 without significant creeping movement as hereinabove set forth.

It is seen therefore that the instant provides an effective floor mat construction which has several significant advantages over the heretofore known floor mat constructions. The floor mat 10 is durable, relatively lightweight, provides an effective longlasting nonskid effect, permits more effective draining and is highly resistant to creep. Further, the efficient construction of the base 12, as defined by the apertures 14, provides a lightweight mat which is easily foldable and has improved cushioning characteristics for fatigue relief. Accordingly, it is seen that nonskid floor mat construction of the instant invention represents a significant improvement in the art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A floor mat construction comprising:

(a) a base made of a rubberized material and having a plurality of apertures therethrough, the upper portions of said aperture being of multisided geometric configuration, said apertures being disposed in adjacent offset rows wherein each of the sides of the upper portions of said apertures, other than those in the peripheral rows on said base, define common walls with adjacent sides of the upper portions of adjacent apertures so that said apertures cooperate to define a honeycomb-like configuration in said base; and (b) a plurality of resiliently flexible spaced feet extending integrally downwardly from the underside of said base to maintain said base in slightly upwardly spaced relation to a supporting surface when positioned thereon, said feet having substantially flat bottom surfaces and being of elongated barbell-like sectional configuration wherein the transverse sectional dimensions of said feet are greater in the opposite end portions thereof than in the central portions thereof.

2. In the floor mat construction of claim 1, said feet being disposed so that adjacent feet are in spaced relation and at angles of approximately 60° with each other.

3. A floor mat construction comprising:

(a) a base made of a rubberized material and having a plurality of apertures therethrough; and (b) a plurality of spaced feet which are resiliently flexible and extend integrally downwardly from the underside of said base, said feed being of elongated barbell-like sectional configuration wherein the transverse sectional dimensions of said feet are greater in the opposite end portions thereof than in the central portions thereof and having substantially flat bottom surfaces which engage said supporting surface when said mat is positioned thereon.

4. In the floor mat construction of claim 3, said feet being disposed so that adjacent feet are in spaced relation and at angles of approximately 60° with each other.

5. A floot mat construction comprising a base made of a rubberized material and having a plurality of apertures therethrough, the upper portions of said apertures being of multisided geometric configuration, the lower portions of said apertures being of downwardly and inwardly tapered substantially circular configuration, said apertures being disposed in adjacent offset rows wherein each of the sides of the upper portions of said apertures, other than those in the peripheral rows on said base, define common walls with adjacent sides of the upper portions of adjacent apertures so that the upper portions of said apertures cooperates to define a honeycomb-like configuration in the upper portion of said base and the inwardly tapered lower portions of said apertures provide increased strength in said base and increased supporting area on the underside of said base, and a plurality of spaced feet of elongated sectional configuration extending integrally downwardly from the underside of said base adjacent the lower portions of said apertures.

6. A floot mat construction comprising:

(a) a base made of a rubberized material and having a plurality of apertures therethrough; and (b) a plurality of spaced feet which are slightly resiliently flexible and extend integrally downwardly from the underside of said base, said feet being of elongated sectional configuration and being disposed so that adjacent feet are at angles of approximately 60° with respect to each other, said feet having substantially flat bottom surfaces which engage said supporting surface when said mat is positioned thereon.

* * * * *